US006129101A

United States Patent [19]

Dubinsky

[11] Patent Number: 6,129,101

[45] Date of Patent: Oct. 10, 2000

[54] GARDEN UMBRELLA HAVING SPECIAL BALLAST WEIGHT FOR FACILITATING CONSTANT CONTROL OF OPENING AND CLOSING OF UMBRELLA

[76] Inventor: Emanuel Dubinsky, 3 Cross Ridge Rd., Chappaqua, N.Y. 10514

[21] Appl. No.: 09/153,908

[22] Filed: Sep. 16, 1998

[51] Int. Cl.[7] ..... A45B 25/12; A45B 25/14; A45B 19/00

[52] U.S. Cl. ..... 135/20.3; 135/22

[58] Field of Search ..... 135/16, 20.3, 22, 135/98, 99

[56] References Cited

U.S. PATENT DOCUMENTS

| | | | |
|---|---|---|---|
| Re. 24,477 | 3/1958 | Small | 135/20.3 |
| 321,722 | 7/1885 | Herron | 135/20.3 X |
| 4,011,881 | 3/1977 | Becher | 135/20.3 |
| 4,567,907 | 2/1986 | Dubinsky | 135/20.3 |
| 4,992,556 | 2/1991 | Dubinsky | 135/20.3 |
| 5,213,122 | 5/1993 | Grady, II | 135/20.3 |
| 5,640,984 | 6/1997 | Dubinsky | 135/22 X |
| 5,711,332 | 1/1998 | Apple | 135/20.3 |

*Primary Examiner*—Carl D. Friedman
*Assistant Examiner*—Kevin D. Wilkens
*Attorney, Agent, or Firm*—Philip Young, Esq.

[57] ABSTRACT

A garden umbrella of the generally large size having a ribholder runner notch adapted for movement along a hollow umbrella pole for operating the canopy ribs to open and close the umbrella canopy. A pulley wheel is mounted in the umbrella pole below its top portion, with one end of a pulley cord being attached to the ribholder runner notch while the other end of the pulley cord extends down through the hollow pole where it connects to a ballast weight. The ballast weight is adapted to travel vertically in the pole in synchronism with movement of the runner notch. The weight of the ballast weight and its pulley arrangement is selected to provide a uniform ballast force and a constant control which facilitates the opening and closing of the umbrella. A second pulley cord can be attached at one end to the runner notch while such cord extends around a second pulley wheel to a handle attached at its other end. The umbrella can be open by pulling down on the pulley cord handle, or by simply lifting the end of one rib to above shoulder height, or by raising the runner notch until the umbrella is fully open. During this opening operation, as the ballast weight is lowered, it provides a uniform and constant upward force on the runner notch which assists in opening the umbrella, thereby substantially reducing the force otherwise required of the umbrella operator. The umbrella is closed by simply pulling down on one rib, or by lowering the runner notch until the umbrella is closed.

20 Claims, 2 Drawing Sheets

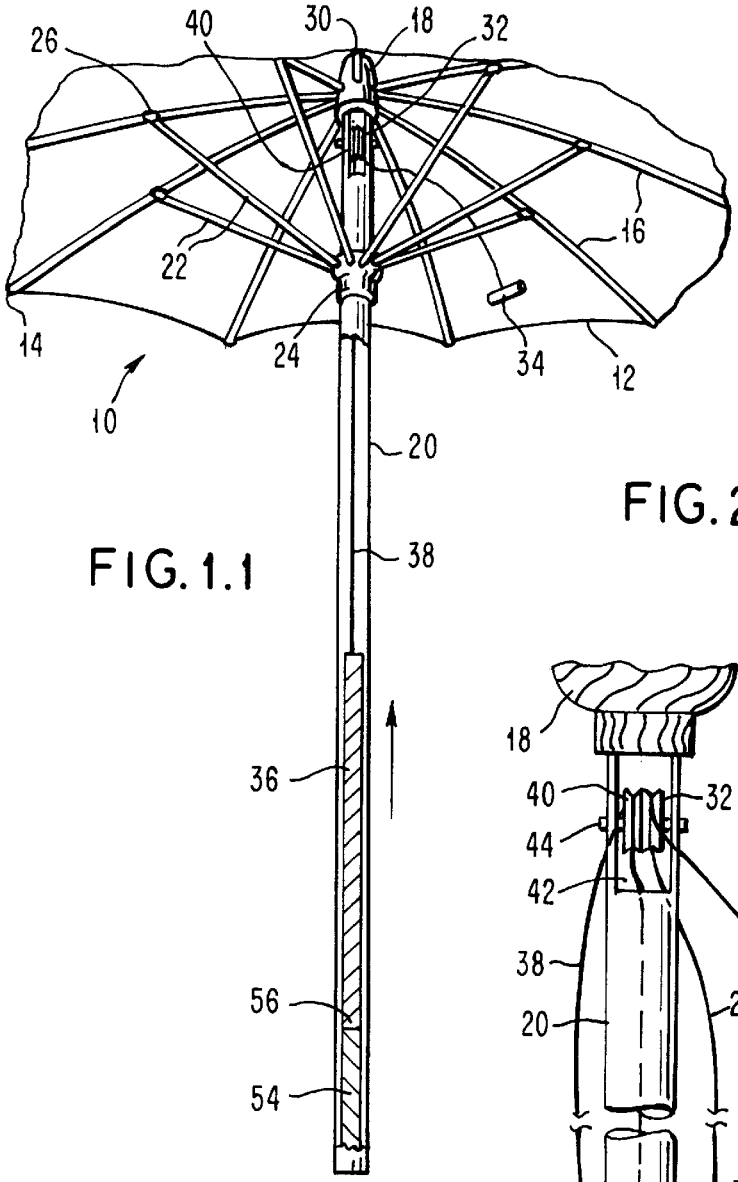
FIG. 1.1
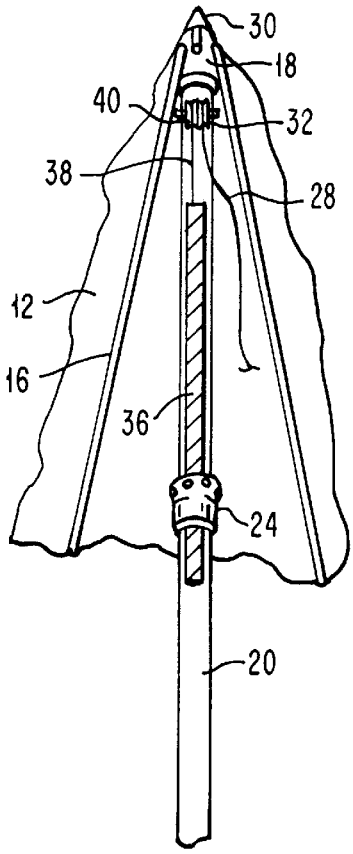
FIG. 2
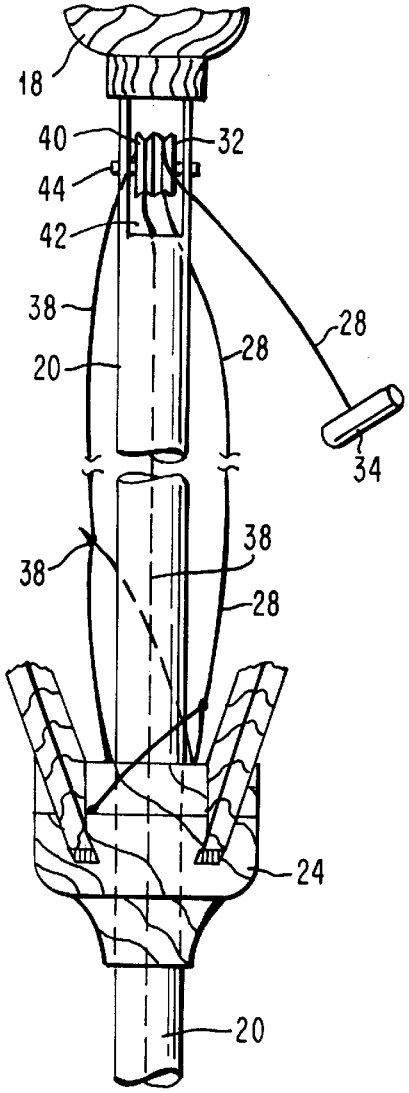
FIG. 1.2

GARDEN UMBRELLA HAVING SPECIAL BALLAST WEIGHT FOR FACILITATING CONSTANT CONTROL OF OPENING AND CLOSING OF UMBRELLA

BACKGROUND OF THE INVENTION

1. Field of the Invention

The present invention relates to umbrellas and, more particularly, to umbrellas of the generally large size used outdoors in the patio and garden and commonly referred to as "garden umbrellas", "patio umbrellas" or "market umbrellas".

2. Background Art

The conventional umbrellas and, more particularly, the larger sized patio, garden and market umbrellas generally are made with a rib support system attached to a means for extending and retracting the ribs to respectively open and close the umbrella. The umbrella commonly has a pulley and cord system wherein the pulley wheel is mounted at the top of the umbrella pole with one end of the pulley cord attached to the umbrella ribholder for lifting the ribs during opening of the umbrella while the other end of the pulley cord is pulled downward by either direct hand manipulation, such as is disclosed by Emanuel Dubinsky, the same inventor as the inventor in the present patent application, in U.S. Pat. No. 4,567,907 issued on Feb. 4, 1986, or by a mechanical hand crank mounted near the lower middle portion of the umbrella pole.

Due to the large size and heavy weight of conventional patio, garden and market umbrellas, various operating mechanisms have been employed to reduce the force otherwise required to raise the runner notch to spread and open the canopy. One such operating mechanism is a spring member disclosed by M.S. Robertson in U.S. Pat. No. 4,807,655 issued on Feb. 28, 1989. One problem with umbrellas of the type employing springs for automatic or assisted opening of the umbrella canopy is that the use of springs causes a non-constant or jerky motion wherein the umbrella operator loses the constant control over the operating path of the runner notch as it moves the ribs to open the canopy to its fully open position. Also, the tension exerted by a spring is highly variable, such that the spring exerts a high tension at one end of the opening cycle and relatively lower tension at the other end of such cycle. Finally, the use of spring mechanisms, as well as other mechanisms, such as the motor driven winding mechanism disclosed by V. Militano, et al in U.S. Pat. No. 3,129,715 issued on Apr. 21, 1964, involve complex parts, resulting in higher costs and a higher maintenance factor.

Also, it is generally necessary to secure the umbrella in its fully open position. This is usually accomplished in the large market umbrella by means of a locking pin which is inserted into a hole set near the top of the umbrella pole, such that the runner sits on top of the locking pin which prevents the umbrella canopy from closing. It would be desirable to provide a means whereby the umbrella is automatically held in its fully open position as it is opened with its runner reaching its highest position near the top of the pole.

SUMMARY OF THE INVENTION

In view of the foregoing, it is an object of the present invention to provide an umbrella of the large size while requiring minimum operator force to open the umbrella. It is another object to provide an umbrella which can be easily opened in a smooth, constant controlled fashion, without the jerky motion common to spring operated umbrellas. It is a further object to provide a means for holding the umbrella in its fully open position, without requiring a conventional locking pin insertion below the runner at the top of the pole.

These, and other objects, are achieved by the present invention which provides a garden umbrella of the generally large size having a ribholder runner notch adapted for movement along a hollow umbrella pole for operating the canopy ribs to open and close the umbrella canopy. A pulley wheel is mounted in the umbrella pole below its top portion, with one end of a pulley cord being attached to the ribholder runner notch while the other end of the pulley cord extends down through the hollow pole where it connects to a ballast weight made of a long solid metal bar. The ballast weight is adapted to travel vertically within the hollow pole in synchronism with movement of the runner notch. The weight of the ballast weight and its pulley arrangement is selected to provide a uniform ballast force and a constant control which facilitates the opening and closing of the umbrella.

A second pulley cord can be attached at one end to the runner notch while such cord extends around a second pulley wheel to a handle attached at its other end. The first and second pulley wheels can be combined in a double pulley wheel for operating, respectively, the cord between the runner notch and the ballast weight, and secondly, the second cord connecting the runner notch and a handle. The umbrella can be open by pulling down on the pulley cord handle, or by simply first lifting the end of one rib to above shoulder height, and then pulling the handle to raise the runner notch until the umbrella is fully open. During this opening operation, as the ballast weight is lowered, it provides a uniform and constant upward force on the runner notch which assists in opening the umbrella, thereby substantially reducing the force otherwise required of the umbrella operator. The umbrella is closed by simply pulling down on one rib, or by lowering the runner notch until the umbrella is closed.

A further improvement in the umbrella operation is provided by locating a permanent magnet at the bottom end of the hollow umbrella pole at the position where the bottom of the ballast weight comes to rest when the umbrella becomes fully open. The magnet holds the iron ballast weight with a sufficient designed force to thereby assist in securing the umbrella in its fully open condition. Here, the magnet assists the ballast weight in automatically holding the umbrella in its fully open position as it is opened with its runner reaching its highest position near the top of the pole. A locking pin can subsequently be inserted into a hole in the pole just below beneath the runner near the top of the pole.

BRIEF DESCRIPTION OF THE DRAWINGS

FIG. 1.1 is a perspective view of an overall patio umbrella taken from the side of the umbrella, taken partially in section to show the position of the ballast weight employed in the umbrella while the canopy is in its fully open position, illustrative of the present invention; and FIG. 1.2 is an enlarged view of a part of FIG. 1.1.

FIG. 2 is a side view of the ballast and pulley system mounted on and within the umbrella pole and frame shown in FIG. 1, while the umbrella is in the closed canopy position:

DESCRIPTION OF THE PREFERRED EMBODIMENTS

Figure 3:
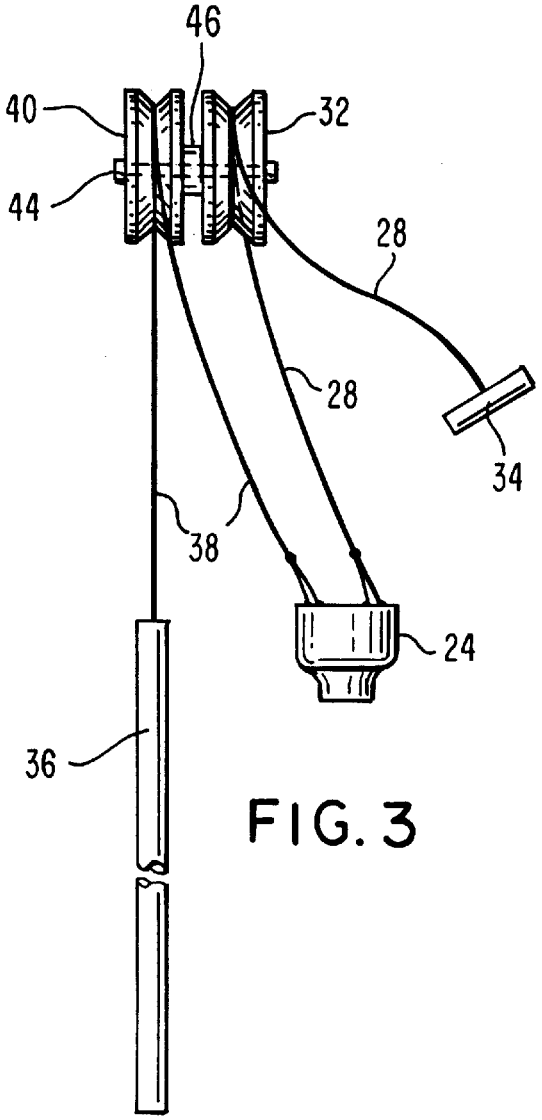
FIG. 3 shows details of the pulley system for the umbrella and ballast system.

Referring FIGS. 1.1 and 1.2, there is shown a side view of a garden umbrella 10 having a canopy 12 which extends from the top portion 30 of umbrella pole 20 down to a canopy tip 14 where each canopy tip 14 is secured to a canopy support rib 16 which is pivotally connected from a top ribholder 18 which is fixed near the top 30 of the pole 20. Stretcher ribs 22 are pivotally connected between a ribholder runner 24 and a central portion of ribs 16 in a conventional manner by rib connectors 26. The ribholder runner 24 is adapted to slide vertically up and down along the umbrella pole 20 for operating the stretcher ribs 22 and canopy ribs 16 as the umbrella canopy 12 is, respectively, opened and closed. A pull cord 28 is attached at one end to a handle 34 and extends in a conventional manner over a handle pulley wheel 32, mounted near the top of pole 20 in a pole opening 42, to ribholder runner 24 at its other end for raising the ribholder runner 24 and thereby opening the umbrella canopy in response to pulling down on the pull cord 28. Generally, the umbrella pole 20 extends through a table top, not shown, and is supported at its lower end by a heavy base or footing member, not shown. FIG. 1.2 is an enlarged view of a part of FIG. 1.1.

Referring to FIG. 1.1 and, more particularly FIG. 2, there is shown the employment of a ballast weight 36, in the form of a three and one half foot long by ¾ to 1 inch diameter solid steel bar, adapted to travel vertically within the hollow pole 20 in synchronism with movement of the ribholder runner 24. A weight pulley wheel 40 is mounted in the pole opening 42, adjacent to the handle pulley wheel 32, near the pole top, with one end of a weight pulley cord 38 being attached to the ribholder runner 24 while the other end of the weight pulley cord 38 extends down through the hollow pole where it connects to ballast weight 36. The ballast weight 36 and its pulley arrangement is selected to provide a uniform ballast force and a constant control which facilitates the opening and closing of the umbrella. Ballast weight 36 is a steel bar designed with its cross-sectional diameter, such as one inch, according to the inside diameter of the hollow pole 20, and with its weight selected in accordance with the upward force required to raise the ribholder runner 24 to open the umbrella ribs and canopy to their fully open position. A typical weight for ballast weight 36 is 15–20 pounds.

Figure 4:
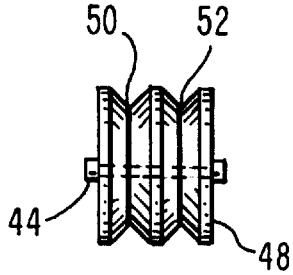
FIG. 4 shows an alternate embodiment of the pulley system shown in FIG. 3.

Referring to FIG. 3, the handle pulley wheel 32 and the weight pulley wheel 40 are rotatably mounted on a common axis 44 with a spacer 46 interposed between such wheel 32 and wheel 40 and mounted on such axis 44. In this embodiment, as described above, the ribholder runner 24 is attached to the handle pulley cord 28 which extends over the handle pulley wheel 32 to the handle 34. Also, the runner 24 is attached to the weight cord 38 which extends over the weight pulley wheel 40 to the weight 36. According to another embodiment shown in FIG. 4, the first and second pulley wheels 32 and 40, shown in FIG. 3, can be combined in a single pulley wheel 48 having separate guide tracks 50 and 52, respectively, for the cords 28 and 38 to control the umbrella operation via the application of force to the runner 24 by the handle and/or the weight 36.

The umbrella can be open by pulling down on the pulley cord handle 34, or by simply first lifting the end of one rib 16 to above shoulder height, and then pulling the handle to raise the runner 24 until the umbrella is fully open. During this opening operation, as the ballast weight 36 is lowered, it provides a uniform and constant upward force on the runner 24 which assists in opening the umbrella, thereby substantially reducing the force otherwise required of the umbrella operator. The umbrella is closed by simply pulling down on one rib, or by lowering the runner 24 until the umbrella is closed.

A further improvement in the umbrella operation is provided by locating a permanent magnet 54 at the bottom end of the hollow umbrella pole 20 at the position where the bottom 56 of the ballast weight 36 comes to rest when the umbrella becomes fully open. The magnet 54 holds the iron ballast weight 36 with a sufficient designed force to thereby assist in securing the umbrella in its fully open condition. Here, as shown in FIG. 1.1, the magnet 54 assists the ballast weight 36 in automatically holding the umbrella in its fully open position as it is opened with its runner 24 reaching its highest position near the top of the pole.

Figure 5:
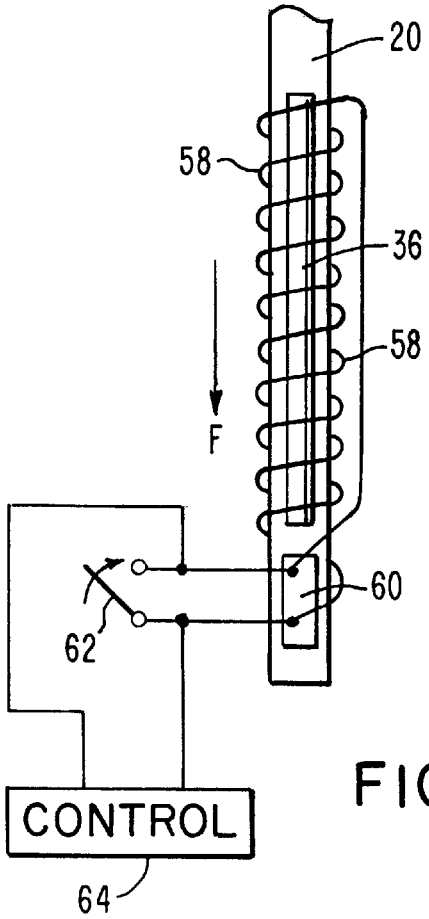
FIG. 5 is a side view of a special magnet arrangement employed with the ballast weight.

FIG. 5 shows a further embodiment of a magnet system wherein an electromagnet includes electric coils 58 and a power source 60 connected with the electromagnet coils 58 encircling the iron ballast weight 36. Here, the electromagnet is designed to provide a downward force F to urge the ballast weight 36 downward for opening the umbrella and maintaining it in its fully open position. The power source can be reversed in polarity, by a switch 62 to provide an upward force when it is desired to apply a closing force, opposite in direction to the force F shown, to raise the weight 36 and thereby lower the ribholder runner 24. A further control 64 can be connected to the power source 60 for increasing or decreasing the electromagnetic force on the iron weight 36 and thereby selectively adjusting the forces applied via the weight 36 to open and close the umbrella.

While the ballast weight system of the present invention may eliminate the need for using the conventional locking pin, if desired, a locking pin, not shown, can subsequently be inserted into a hole in the pole just below beneath the runner 24 near the top of the pole 20 to further secure the umbrella in its open position.

In this fashion, there is provided an umbrella of the large size wherein a minimum operator force is required to open the umbrella. Also, the present invention provide an umbrella which can be easily opened and closed in a smooth, constant controlled fashion, without the jerky motion common to spring operated umbrellas. Also, there is provided a means for holding the umbrella in its fully open position, without requiring the additional operator step of inserting a conventional locking pin into a hole below the runner at the top of the pole.

While the invention has been described above with respect to its preferred embodiments, it should be understood that other forms and embodiments may be made without departing from the spirit and scope of the present invention.

What is claimed is:

1. In an umbrella having an umbrella pole, frame support ribs for supporting an umbrella canopy, including canopy cover ribs being pivotally connected to stretcher ribs for opening and closing said umbrella, and a ribholder runner connected to one end of each of said stretcher ribs and encircling said umbrella pole and adapted for slidable movement along said pole for raising and lowering said stretcher ribs for pivotally extending and retracting said canopy cover ribs for respectively opening and closing said umbrella, the improvement of which comprises:

(a) said umbrella pole having a tubular form with a hollow transverse cross-section;

(b) a ballast weight being adapted for vertical movement in said hollow umbrella pole; and (c) pulley means mounted on said pole at a position near the top thereof and vertically above said ribholder runner when said umbrella is in its closed position, said pulley means including a pulley wheel mounted on said umbrella pole, and a pulley cord having one end attached to said ribholder runner while the other end of said pulley cord extends over said pulley wheel and down through the hollow pole where it connects to said ballast weight, said ballast weight being operatively connected to said canopy cover ribs for pivotally extending and retracting said canopy cover ribs for respectively opening and closing said umbrella, whereby said ballast weight is adapted to travel vertically downward in the pole in synchronism with both the pivotal extension of said canopy cover ribs and the raising of said stretcher ribs by the upward movement of said runner for opening said umbrella, the weight of said ballast selected to provide a uniform ballast force and a constant control which facilitates the opening and closing of the umbrella.

2. An umbrella as recited in claim 1, further comprising handle means operatively connected to said ribholder runner for raising said ribholder for raising said stretcher ribs for pivotally extending said canopy cover ribs for thereby opening said umbrella.

3. An umbrella as recited in claim 2, wherein said handle means includes a further pulley cord attached at one end to said runner while said further pulley cord extends around a second pulley wheel to a handle attached at its other end, whereby said umbrella can be open by pulling down on the pulley cord handle to raise said ribholder runner.

4. An umbrella as recited in claim 3, wherein said first pulley wheel and said second pulley wheel are supported on a common axle for rotation thereon.

5. An umbrella as recited in claim 1, wherein said pulley wheel comprises two pulley tracks, a first track for operatively receiving said pulley cord attached to said ballast weight and said ribholder runner, and a second track; and further comprising a further pulley cord which extends around said second track and is attached at one end to said ribholder runner, and a handle attached to the other end of said further pulley cord for raising and lowering said ribholder runner and thereby opening and closing said umbrella, respectively.

6. An umbrella as recited in claim 1, wherein said ballast weight comprises an elongated heavy material in the shape of a long pole which fits within said hollow pole and has a weight which assists in the raising of said ribholder runner as said ballast weight is lowered.

7. In an umbrella having an umbrella pole, frame support ribs for supporting an umbrella canopy, including canopy cover ribs being pivotally connected to stretcher ribs for opening and closing said umbrella, and a ribholder runner connected to one end of each of said stretcher ribs and encircling said umbrella pole and adapted for slidable movement along said pole for raising and lowering said stretcher ribs for pivotally extending and retracting said canopy cover ribs for respectively opening and closing said umbrella, the improvement of which comprises:

(a) said umbrella pole having a tubular form with a hollow transverse cross-section;

(b) a ballast weight being adapted for vertical movement in said hollow umbrella pole;

(c) pulley means mounted on said pole at a position near the top thereof and vertically above said ribholder runner when said umbrella is in its closed position, said pulley means including a pulley wheel mounted on said umbrella pole, and a pulley cord having one end attached to said ribholder runner while the other end of said pulley cord extends over said pulley wheel and down through the hollow pole where it connects to said ballast weight, said ballast weight being operatively connected to said canopy cover ribs for pivotally extending and retracting said canopy cover ribs for respectfully opening and closing said umbrella, the weight of said ballast selected to provide a uniform ballast force and a constant control which facilitates the opening and closing of the umbrella; and (d) said ballast weight being made of an iron material, and further comprising magnet means located near said ballast weight so as to produce a magnetic field with forces that urge said ballast weight in a downward direction.

8. An umbrella as recited in claim 7, wherein said magnet means comprises a permanent magnet located near the bottom of said hollow umbrella pole at the position where the bottom of said ballast weight comes to rest on said permanent magnet when said umbrella is fully open, said permanent magnet producing a magnetic force which attracts said ballast weight thereto and assists said ballast weight in holding said umbrella in the fully open position.

9. An umbrella as recited in claim 7, wherein said ballast weight is made of an iron material, and further comprising electromagnet means mounted around said umbrella pole to produce an electromagnetic field around said ballast weight which produces a desired vertical force on said ballast weight.

10. An umbrella as recited in claim 9, wherein said electromagnet means is designed to produce a downward vertical force on said ballast weight which assists in holding said umbrella open.

11. An umbrella as recited in claim 9, wherein said electromagnet means includes an electric power source, further comprising control means for selectively changing the polarity of the electric power to said electromagnet means to change the direction of the magnetic field and force on said ballast weight.

12. An umbrella as recited in claim 9, wherein said electromagnet means includes an electric power source, further comprising control means for selectively increasing and decreasing the magnitude of the electric power to said electromagnet means to accordingly change the magnitude of the magnetic field and force on said ballast weight.

13. In an umbrella having an umbrella pole, frame support ribs for supporting an umbrella canopy, including canopy cover ribs being pivotally connected to stretcher ribs for opening and closing said umbrella, and a ribholder runner connected to one end of each of said stretcher ribs and encircling said umbrella pole and adapted for slidable movement along said pole for raising and lowering said stretcher ribs for pivotally extending and retracting said canopy cover ribs for respectively opening and closing said umbrella, the improvement of which comprises:

(a) said umbrella pole having a tubular form with a hollow transverse cross-section;

(b) a ballast weight made of an elongated iron material and adapted for vertical movement in said hollow umbrella pole;

(c) pulley means mounted on said pole at a position near the top thereof and vertically above said ribholder runner when said umbrella is in its closed position, said pulley means including a pulley wheel mounted on said umbrella pole, and a pulley cord having one end attached to said ribholder runner while the other end of said pulley cord extends over said pulley wheel and down through the hollow pole where it connects to said ballast weight, said ballast weight being operatively connected to said canopy cover ribs for pivotally extending and retracting said canopy cover ribs for respectively opening and closing said umbrella, whereby said ballast weight is adapted to travel vertically downward in the pole in synchronism with movement of said runner for opening said umbrella; and (d) magnet means located near said ballast weight so as to produce a magnetic field with forces that urge said ballast weight in a desired direction.

14. An umbrella as recited in claim 13, further comprising handle means operatively connected to said ribholder runner for raising said ribholder for raising said stretcher ribs for pivotally extending said canopy cover ribs for thereby opening said umbrella.

15. An umbrella as recited in claim 14, wherein said handle means includes a further pulley cord attached at one end to said runner while said further pulley cord extends around a second pulley wheel to a handle attached at its other end, whereby said umbrella can be open by pulling down on the pulley cord handle to raise said ribholder runner.

16. An umbrella as recited in claim 13, wherein said pulley means comprises said pulley wheel having two tracks, a first track for operatively receiving said pulley cord attached to said ballast weight and said ribholder runner, and a second track; and further comprising a further pulley cord which extends around said second track and is attached at one end to said ribholder runner, and a handle attached to the other end of said further pulley cord for raising and lowering said ribholder runner and thereby opening and closing said umbrella, respectively.

17. An umbrella as recited in claim 13, wherein said magnet means comprises a permanent magnet located near the bottom of said hollow umbrella pole at the position where the bottom of said ballast weight comes to rest on said permanent magnet when said umbrella is fully open, said permanent magnet producing a magnetic force which attracts said ballast weight thereto and assists said ballast weight in holding said umbrella in the fully open position.

18. An umbrella as recited in claim 13, wherein said magnet means comprises electromagnet means mounted around said umbrella pole to produce an electromagnetic field around said ballast weight which produces a desired vertical force on said ballast weight.

19. An umbrella as recited in claim 18, wherein said electromagnet means includes an electric power source, further comprising control means for selectively changing the polarity of the electric power to said electromagnet means to change the direction of the magnetic field and force on said ballast weight.

20. An umbrella as recited in claim 18, wherein said electromagnet means includes an electric power source, further comprising control means for selectively increasing and decreasing the magnitude of the electric power to said electromagnet means to accordingly change the magnitude of the magnetic field and force on said ballast weight.

* * * * *